US006827179B2

(12) United States Patent
Drake et al.

(10) Patent No.: US 6,827,179 B2
(45) Date of Patent: Dec. 7, 2004

(54) SOUND BARRIER SYSTEM

(75) Inventors: Christina M. Drake, Tell City, IN (US); Terry A. Murphy, Georgetown, KY (US); Scott J. Federico, Louisville, KY (US); Joe C. Anderson, Owensboro, KY (US); Paul S. Pirkle, Prospect, KY (US); Patrick D. King, Louisville, KY (US); Stephen P. Kozusko, Louisville, KY (US); Michael C. Westfall, Sellersburg, IN (US)

(73) Assignee: Commonwealth Industries, Inc., Louisville, KY (US)

( * ) Notice: Subject to any disclaimer, the term of this patent is extended or adjusted under 35 U.S.C. 154(b) by 44 days.

(21) Appl. No.: 10/397,071

(22) Filed: Mar. 25, 2003

(65) Prior Publication Data

US 2004/0003964 A1 Jan. 8, 2004

Related U.S. Application Data

(60) Provisional application No. 60/367,445, filed on Mar. 25, 2002, and provisional application No. 60/439,103, filed on Jan. 10, 2003.

(51) Int. Cl.[7] ..... E04B 1/82
(52) U.S. Cl. ..... 181/290
(58) Field of Search ..... 181/290, 284–289, 181/291, 292, 293, 294, 296

(56) References Cited

U.S. PATENT DOCUMENTS

| | | | | |
|---|---|---|---|---|
| 4,358,090 A | | 11/1982 | Glaesener | |
| 4,433,021 A | | 2/1984 | Riel | |
| 4,480,715 A | | 11/1984 | Brooks | |
| 4,600,078 A | | 7/1986 | Wirt | |
| 4,800,984 A | * | 1/1989 | Kerman | 181/290 |
| 4,838,524 A | | 6/1989 | McKeown et al. | |
| 4,899,498 A | | 2/1990 | Grieb | |
| 5,020,632 A | * | 6/1991 | Nelson | 181/290 |
| 5,217,771 A | | 6/1993 | Schmanski et al. | |
| 5,268,540 A | | 12/1993 | Rex | |
| 5,272,284 A | | 12/1993 | Schmanski | |
| 5,469,932 A | | 11/1995 | McNair | |
| 5,564,241 A | | 10/1996 | Ogorchock et al. | |
| 5,575,121 A | | 11/1996 | Lajaunie | |
| 5,678,363 A | | 10/1997 | Ogorchock et al. | |
| 6,016,887 A | | 1/2000 | Underhill et al. | |
| 6,021,612 A | | 2/2000 | Dunn et al. | |

FOREIGN PATENT DOCUMENTS

| | | |
|---|---|---|
| CH | 672932 | 1/1990 |
| DE | 2929853 A1 | 2/1981 |
| DE | 9105831 | 8/1991 |
| EP | 0527115 A1 | 2/1993 |
| EP | 0843045 A1 | 5/1998 |

* cited by examiner

*Primary Examiner*—Kimberly Lockett
(74) *Attorney, Agent, or Firm*—Greenebaum Doll & McDonald PLLC; Alexander P. Brackett

(57) ABSTRACT

The present invention provides a sound barrier system 10 including a sound barrier panel 20 having a face skin panel 30 held in spaced relation from a back skin panel 40 by a filler material 50. Each sound barrier panel 20 is provided with a tongue and groove design that permits panels 20 to be stacked in an interlocking fashion without fastening hardware.

19 Claims, 5 Drawing Sheets

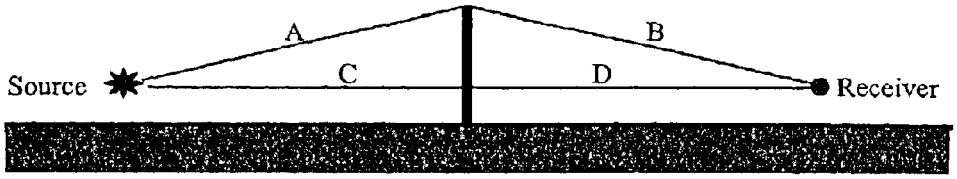
Fig. 1 Barrier Geometry
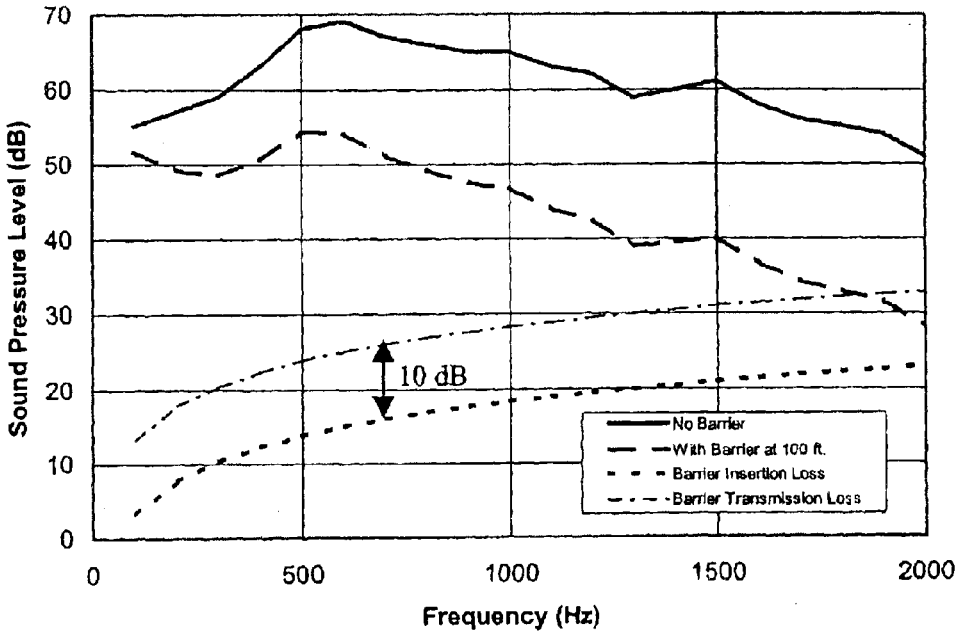
Fig. 2

SOUND BARRIER SYSTEM

This application claims the benefit of U.S. provisional patent application Ser. No. 60/367,445 filed Mar. 25, 2002 and U.S. provisional patent application Ser. No. 60/439,103 filed Jan. 10, 2003.

FIELD OF THE INVENTION

The present invention relates generally to a system for attenuating sound transmission between a sound source and a destination and specifically to a sound barrier system capable of economical mass manufacture to lessen the impact of the noise caused by vehicular traffic or construction in nearby areas.

BACKGROUND OF THE INVENTION

In a growing number of transportation related settings, federal, state and local governments are specifying, supplying and installing sound barriers between roadways and the surrounding areas, particularly in areas of high traffic volume. Sound barriers are desirable in residential and commercial areas proximate interstate highways to attenuate noise in neighborhoods, shopping districts, and other commercial areas caused by traffic.

Various materials are presently employed in the design and manufacture of various sound barriers. Prior art barrier designs constructed of steel, concrete, cement board, wood, and earthen barriers have been employed to effect a reduction of ambient noise levels proximate noisy roadways or construction sites. However, each have various disadvantages that make widespread production and installation impractical, either due to cost, manufacture and installation complexity, or poor sound attenuation.

Steel and metal barriers are prone to denting and chipping, as well as corrosion, and are extremely heavy. Wood barriers require periodic maintenance and have a comparatively short useful life. Concrete and cement barriers are very expensive to produce and install. Earthen barriers require a great deal of space to erect and are subject to erosion over time. Furthermore, each of these barrier designs requires labor intensive installation techniques, thereby placing a premium on product life. Additionally, none of the aforementioned barrier designs are particularly aesthetically pleasing, and all are susceptible to the application of graffiti and the like.

Additionally, the installation of many prior art sound barriers requires an excess of installation hardware and complex mechanical hardware for assembling the barrier panels. Concrete and steel barriers require heavy equipment to place the barriers, and robust structural supports to hold the barriers in place due to their weight. Furthermore, the labor required to construct these barrier systems is quite costly.

Since sound barriers are often used to protect residential areas, hospitals, schools, and housing developments from high noise areas like roadways, construction sites, and shopping centers, the design and construction of economical and easily installed barriers is of particular import to quality of life in the modern world.

SUMMARY OF THE INVENTION

The present invention solves the aforementioned problems by providing an economical sound barrier that is capable of production by modern mass manufacturing techniques and easily installed in a plurality of noise reduction applications. The sound barrier system of the instant invention utilizes a plurality of barrier panels constructed of aluminum skin panels. The aluminum panels may be of varying gauges and have varying gaps and filler materials therebetween, depending upon application requirements. Furthermore, the barrier panels are readily installed by mounting on extruded or welded poles of steel or aluminum with a minimum of hardware. The barrier panel design of the present invention provides for modular panels that are vertically interlocking to achieve a sound barrier system of a desired height without the need to construct panels that are both wide and tall.

In a typical barrier installation, sound transmitted from a source (e.g., vehicular traffic) reaches a receiver by two paths. The first path, shown in FIG. 1 is the distance (C+D) is a path taken by sound transmitted through the barrier. The second path, shown as the distance (A+B) is a path taken by sound passing over the barrier.

The sound passing through the barrier should be minimized in order to maximize the effectiveness of a barrier for a given application. The barrier construction must be such that the sound transmitted via the path C+D is much less than the sound diffracted over the barrier via path A+B. The sound passing over the barrier via path A+B depends on a plurality of factors that vary with each installation including but not limited to barrier height and length, source and receiver height, ground contour and impedance, wind direction and velocity, and temperature gradients.

If a given barrier meets a minimum standard of sound attenuation, as described in further detail hereinbelow, the sound passing over the barrier is independent of the barrier material and construction. Any sound transmitted via the path C+D depends upon the barrier material, design, and construction details. It is independent of the installation-specific factors mentioned above.

The minimum standard for barrier attenuation is determined by assuming an ideal barrier (one in which no sound is transmitted via path C+D), wherein the only sound reaching the receiver is via path A+B. As one example, consider an application wherein a barrier having height of 12 feet is employed, wherein the distances A=B=100 feet are assumed so that the barrier is disposed equidistant from the source and the receiver. For purposes of this analysis it is given that the barrier is very long such that transmitted sound does not reach the receiver by passing around the ends of the barrier. Furthermore, wind and temperature gradients are negligible, and the ground is flat with no ground effect.

FIG. 2 is a graph of the sound pressure level in decibels (dB) at the receiver with and without an ideal noise barrier present. FIG. 2 further shows the insertion loss of the barrier for this example. The insertion loss is simply the difference between the sound pressure level at the receiver with and without the barrier in place. In order for a given barrier in FIG. 2 to meet the minimum required standard of sound attenuation, the transmission loss of the barrier (the attenuation of sound through the barrier via path C+D) must be much greater than the barrier's insertion loss; 10 dB is typically required in the industry. The transmission loss of a barrier using the 10 dB criterion is also plotted in FIG. 2.

The aluminum barrier panels provided by the present invention provide the requisite reduction in sound transmission while being extremely lightweight and easily installed. Furthermore, the barrier panels of the present invention are amenable to embossing and to the application of coatings and colors with a wide variety of patterns by modern manufacturing technique, at relatively low cost. This feature of the invention allows for an economical sound barrier that is aesthetically pleasing as well as resistant to graffiti.

It is therefore one object of the instant invention to provide an improved sound attenuation barrier device for use near high-noise areas.

A further object of the invention is a lightweight sound barrier system.

A further object of the invention is an easily manufactured sound barrier that is low in cost.

A further object of the invention is a sound barrier that is installed with a minimum of labor and hardware cost.

A further object of the invention is a sound barrier having a plurality of embossed textures and color coatings, for improved aesthetic appearance.

Other uses, advantages, and features of the instant invention will become apparent after reading the detailed description of the preferred embodiments taken in conjunction with the accompanying drawing figures.

BRIEF DESCRIPTION OF THE DRAWING FIGURES

FIG. 1 is a diagram of sound barrier layout geometry in accordance with the present invention.

FIG. 2 is a graph of sound pressure levels in various sound barrier configurations.

DETAILED DESCRIPTION OF THE PREFERRED EMBODIMENTS

Figure 3:
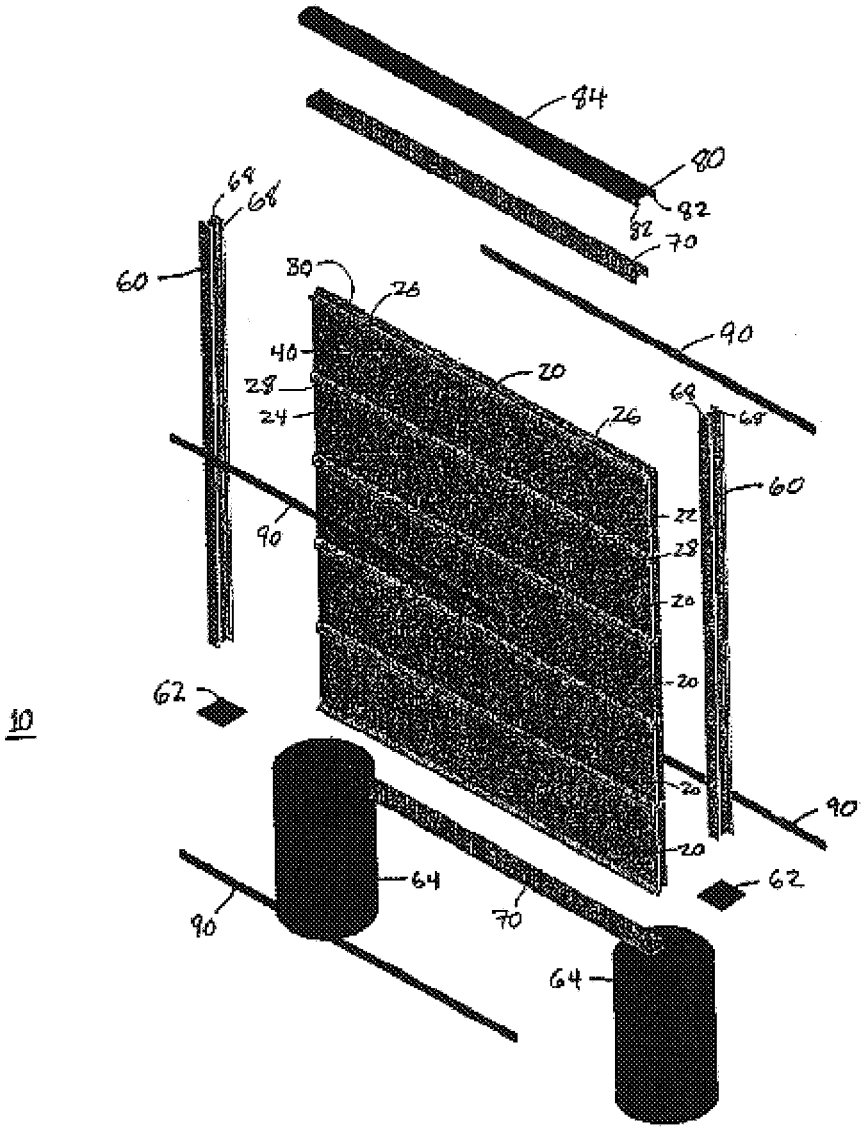
FIG. 3 is an exploded isometric view of the sound barrier system of the present invention.

As shown in drawing FIGS. 3–6, a sound barrier system 10 for reducing the sound transmitted between a sound source and a destination includes a sound barrier panel 20 having a face skin panel 30 and a back skin panel 40, each made from aluminum or aluminum alloy to provide a lightweight, inexpensive and corrosion resistant barrier panel 20. The barrier panel 20 has a pair of opposed sides 22 and 24, a top edge 26, and a bottom edge 28.

Figure 4:
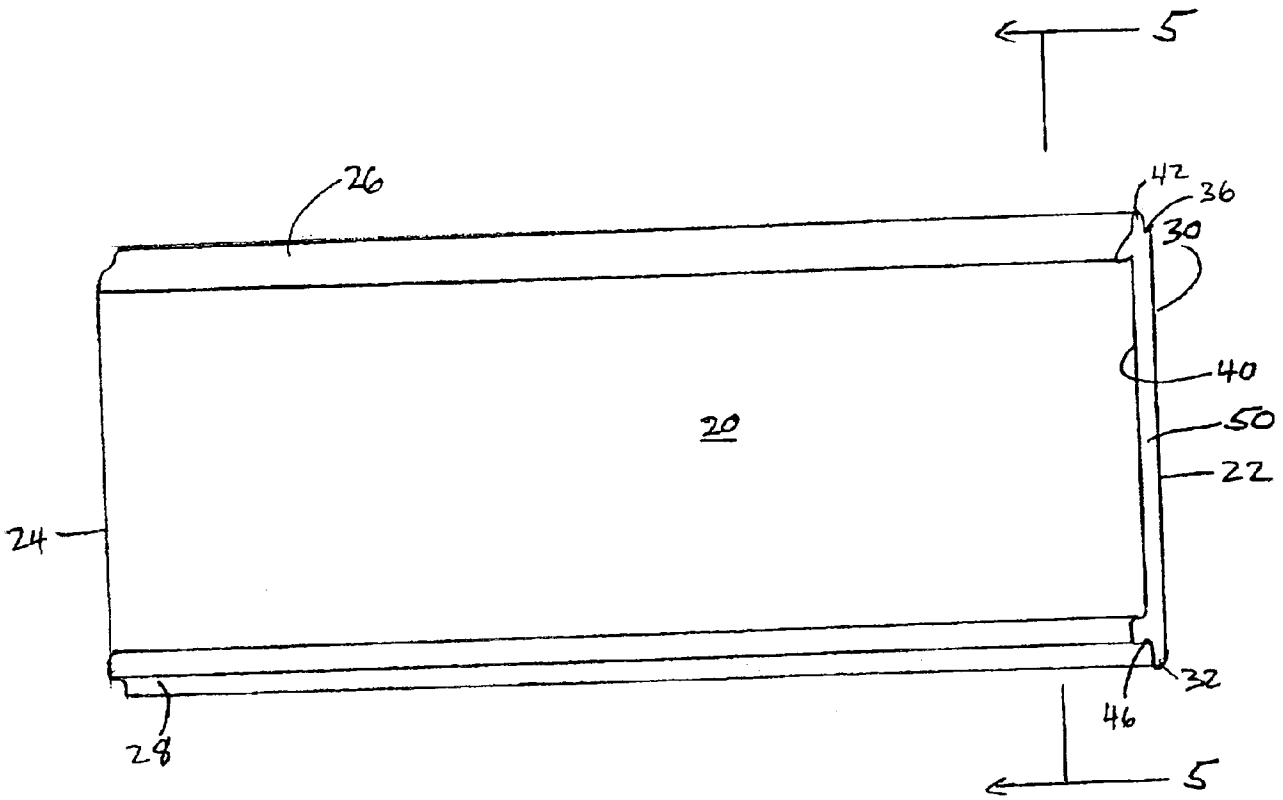
FIG. 4 is a view of a sound barrier panel in accordance with the present invention.
Figure 5:
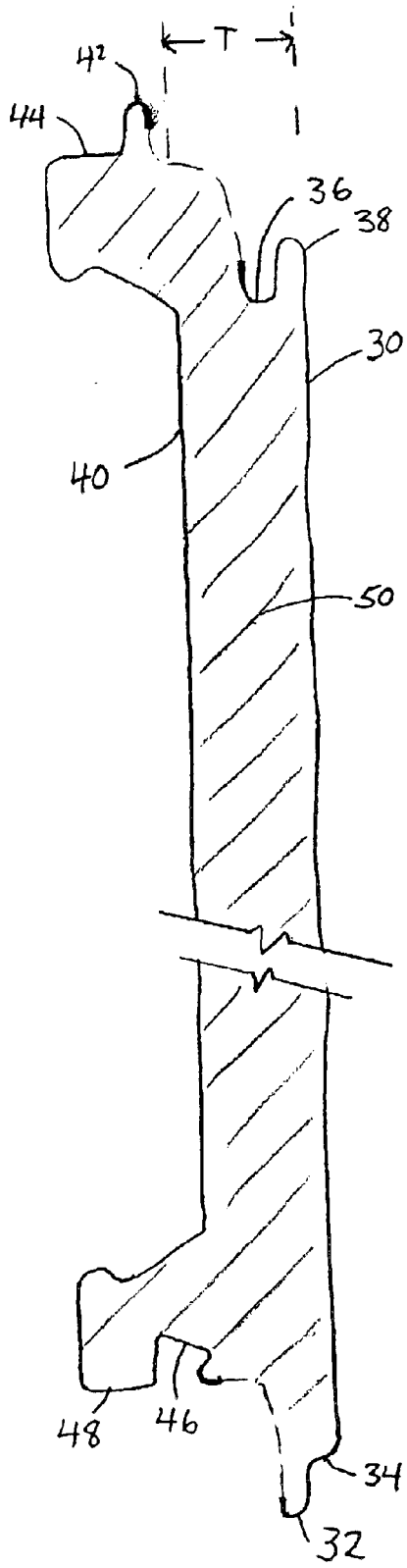
FIG. 5 is a view of a sound barrier panel taken along the line 5—5 of FIG. 4.
Figure 6:
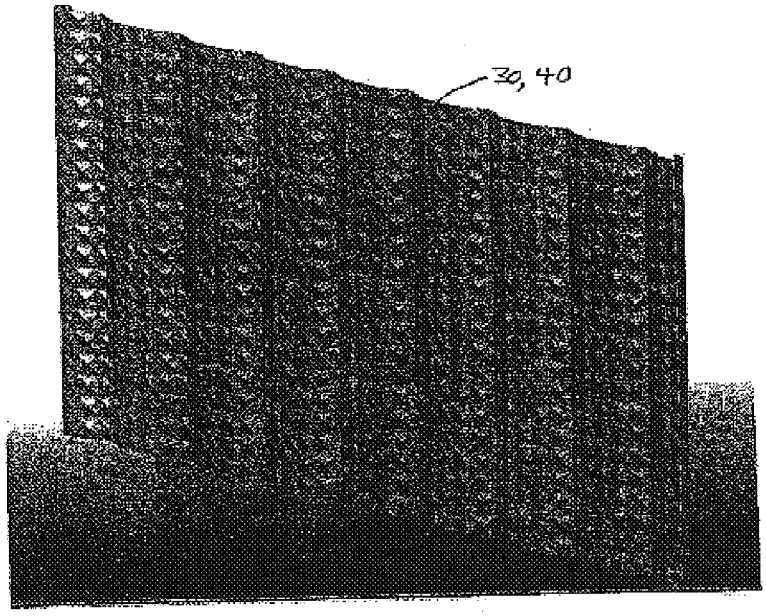
FIG. 6 is a view of a textured skin panel in accordance with one embodiment of the invention.

As best seen in FIGS. 4 and 5 the face skin panel 30 includes a tongue portion 32 that protrudes from and extends along a bottom edge 34 or side of the face skin panel 30. Additionally, a groove 36 extends along a top edge 38 of the face skin panel 30.

Similarly, the back skin panel 40 has a tongue 42 protruding from and extending along a top edge 44 thereof, and additionally has a corresponding groove 46 that extends along a bottom edge 48 thereof.

The face skin panel 30 is spaced from the back skin panel 40 by a sound absorbing filler material 50 that is used to enhance the sound absorption of the barrier system 20. A variety of known-in-the-art filler materials 50 may be employed in the present invention, for example, open-cell foam, composite materials such as compressed rubber chips and binder, or closed-cell foam or various polyurethane closed cell compositions. In a preferred embodiment of the invention, a filler material 50 that provides a sound barrier panel 20 having a sound transmission coefficient of at least 22 decibels is used. Closed-cell polyurethane is a particularly suitable filler material 50 as it is both inexpensive and weather-resistant.

The face skin and back skin panels 20 and 30 respectively may be produced from aluminum sheet having a variety of gauge thicknesses. Skin panels having gauge thicknesses that range from 0.02 to 0.3 are acceptable gauge thicknesses that may be employed in the present invention, depending upon the overall dimensions (length and width) of the barrier panel 20 desired. In one embodiment of the present invention the barrier panel 20 has an overall thickness (shown as dimension "T" on drawing FIG. 5) of 4" when using face 30 and skin 40 panels made from 0.038 gauge aluminum. This embodiment of the invention provides a barrier panel 20 having sufficient lateral stiffness to be fabricated in heights up to 10 feet and widths up to 20 feet, and have a sound transmission coefficient of not less than 22 dB when closed-cell polyurethane is employed as filler material 50.

The aluminum sheet used for the face skin panels 20 and back skin panels 30 may be any one of a variety of known-in-the-art aluminum alloys designed for varying degrees of corrosion resistance, ductility and appearance. Instructive examples of aluminum alloys suitable for use in the panels of the present invention are 3000 series or 5000 series aluminum alloys.

Referring to FIG. 3, the barrier system 10 of the present invention can also include a plurality of structural support columns 60 to retain the sound barrier panels 20 in a desired position. A wide variety of support column designs may be employed, for example aluminum or steel I-beams, posts, pilasters, angles or channel.

In one embodiment of the present invention, as best seen in FIG. 3, a plurality of aluminum columns 60 are positioned spaced apart and disposed substantially vertically wherein the distance between the columns is approximately the width of a barrier panel 20. The columns 60 may be secured with conventional fasteners to a base plate 62 mounted on a concrete form 64, as is well known in the art or simply cemented in the ground, as is required for a given barrier system 10 application. Additionally, the columns 60 may be secured to an existing road surface, for example an overpass or a bridge deck, to permit barrier panel 20 installation proximate an existing roadway requiring a sound barrier system 10.

Once the columns 60 are set, a barrier panel 20 is positioned between the columns 60 and the opposed edges 22 and 24 of the panels are secured thereto by conventional fastening means such as bolts, screws or rivets. In one embodiment of the present invention wherein the columns employed have an I-beam configuration, the barrier panel 20 is positioned so that the opposed sides 22 and 24 thereof are held in place by I-beam flanges 68, thence secured to the flanges 68 by fasteners. This embodiment of the invention 10 provides a barrier panel 20 that is exceptionally stable and suitable for use in applications where wind loading is a necessary consideration.

The system 10 of the present invention may further include a u-channel 70, or a plurality thereof, having lengths that approximate the width of the barrier panels that engage the top and bottom edges 26 and 28 of the sound barrier panel 20 to provide protection thereto. The u-channels 70 are secured with conventional fasteners at a plurality of locations to both the barrier panel 20, and the columns 60, thereby providing enhanced system 10 rigidity. Furthermore a u-channel shaped top cap 80 may be employed to cover the u-channel 70 engaged with the top edge 26 of the barrier panel 20 to provide further protection for the barrier panel 20 from the effects of the elements. As shown in FIG. 3 the top cap 80 is positioned with its legs 82 pointing down. Furthermore, it is preferable that the top cap 80 have a top surface 84 that is slightly convex in shape to inhibit the pooling of rain water on the surface 84.

In a yet further embodiment of the present invention a plurality of cross-beams 90 may be positioned such that they bridge the space between the columns 60 and are secured thereto. The cross-beams 90 may also be secured to the barrier panel 20 at a plurality of locations using conventional fasteners to provide enhanced structural rigidity for high wind-load or long span applications.

In operation, the design of the barrier panels 20 described hereinabove permits barrier panels 20 to be stacked to achieve an overall desired height. The tongue 32 of the face skin panel 20 engages the groove 36 of a face skin panel 30 of the sound barrier 20 positioned therebelow. Similarly, the tongue 42 and groove 44 portions of the back skin panel are designed to engage one another on two panels 20, one positioned atop the other. Thus the barrier panels 20 have a modular interlocking capability that permits the panels to be stacked vertically to achieve any desired barrier height with a minimum of fastener hardware, since the panels 20 do not need to be fastened together where the tongues and grooves of a first panel 20 engage the complimentary tongues and grooves of a second panel 20.

In a further embodiment of the present invention, a plurality of aluminum sound barrier panels 20 may be constructed having embossed patterns on either the face skin panel 30, the back skin panel 40, or both. An exemplary skin panel 30 or 40 having a diamond pattern embossed thereon is depicted in drawing FIG. 6. The aluminum alloy construction of the barrier panel 20 is particularly amenable to accepting embossed patterns to provide surface texture to the panel 20.

Furthermore, a variety of color coatings may be applied to the face 30 and back 40 panels of the present invention, either alone or in conjunction with embossed patterns, at relatively low cost. Additionally, some known-in the-art coatings for aluminum alloys are resistant to the application of graffiti, thereby providing an improvement over prior art wood and concrete barriers. Embossed patterns that may be roll-formed into the barrier panels 20 in conjunction with the present invention include, but are not limited to brick patterns and variations thereof, stone patterns, bronze and metallic deck plate and knurled patterns, stone patterns and variations thereof, cobblestone patterns, wood grain patterns, diamond patterns, etc. A nearly limitless variety of patterns may be embossed on the sound barrier panels 20 of the present invention by modern manufacturing techniques such as roll forming.

A variety of color coatings may also be applied to the barrier panels 20 to enhance the appearance thereof. While a simple one-color coating may be employed on the back skin panel 40, a multiple color application can be given to the face skin panel 40 to provide a pleasant aesthetic appearance. Multiple coatings may be rolled onto embossed patterned panels 20 to simulate brick or stone or wood grain. Additionally, the color coatings suitable for use on aluminum alloy panels are capable of providing corrosion resistance, scratch resistance, UV light protection, and graffiti resistance. An illustrative example of suitable color coatings for use on the aluminum-skinned barrier panel 20 are coatings capable of being applied during a continuous coil coating process during the production of the aluminum sheet necessary to fabricate the skin panels 30 and 40. Coating capable of application in a continuous coil process permit the panels 20 to be fabricated while already coated, thereby elimination costly coating of finished panels 20. Exemplary coatings that may be used on the panels 20 of the present invention include simple polyester based coatings, fluorocarbon based coatings, and fluoropolymer based coatings.

The foregoing detailed description of the preferred embodiments is considered as illustrative only of the principles of the invention. Since the instant invention is susceptible of numerous changes and modifications by those of ordinary skill in the art, the invention is not limited to the exact construction and operation shown and described, and accordingly, all such suitable changes or modifications in structure or operation which may be resorted to are intended to fall within the scope of the claimed invention.

We claim:

1. A sound barrier system for reducing the sound transmitted between a source of sound and a destination comprising:

a sound barrier panel having a face skin panel adapted to face the source of sound and a back skin panel held in spaced relation thereto by a filler material, the face skin panel having a pair of opposed sides, a top side having a groove therein, and a bottom side having a tongue portion depending therefrom, the back skin panel having a pair of opposed sides, a top side having a tongue portion depending therefrom, and a bottom side having a groove therein; and wherein a plurality of sound barrier panels may be interlocked one atop another whereby the tongue portions of the back skin panel and the groove portions of the face skin panel of a first sound barrier panel are received by the complementary tongue and groove portions of a second sound barrier panel.

2. The sound barrier system of claim 1, wherein the filler material is closed cell polyurethane foam.

3. The sound barrier system of claim 1, wherein the filler material is a composite material.

4. The sound barrier system of claim 1, wherein the back skin panel and the face skin panel are comprised of aluminum.

5. The sound barrier system of claim 1, wherein the back skin panel and the face skin panel are comprised of aluminum alloy.

6. The sound barrier system of claim 4, wherein the back skin panel and the face skin panel are textured.

7. The sound barrier system of claim 5, wherein the back skin panel and the face skin panel are textured.

8. The sound barrier system of claim 4 further comprising at least one coating applied to the back skin panel and the face skin panel to provide protection thereto from the elements.

9. The sound barrier system of claim 5 further comprising at least one coating applied to the back skin panel and the face skin panel to provide protection thereto from the elements.

10. The sound barrier system of claim 8 further wherein said coating is a polyester based coating.

11. The sound barrier system of claim 8 further wherein said coating is a fluorocarbon based coating.

12. The sound barrier system of claim 8 further wherein said coating is a fluoropolymer based coating.

13. The sound barrier system of claim 9 further wherein said coating is a polyester based coating.

14. The sound barrier system of claim 9 further wherein said coating is a fluorocarbon based coating.

15. The sound barrier system of claim 9 further wherein said coating is a fluoropolymer based coating.

16. The sound barrier system of claim 1 further comprising at least two spaced apart columns for securing said sound barrier panel thereto.

17. The sound barrier system of claim 16 further comprising first and second u-channels, the first u-channel positioned over the bottom sides of the face and skin panels, and the second u-channel positioned over the top sides thereof.

18. The sound barrier system of claim 17 further comprising a top cap having a u-channel shape and positioned over the first u-channel to protect the sound barrier panel from the elements.

19. The sound barrier system of claim 16 wherein said spaced apart columns comprise I-beams, each of said I-beams having a pair of flanges depending therefrom wherein said sound barrier is secured between the flanges of said I-beams.

* * * * *